US007169228B2

(12) United States Patent
Schneider

(10) Patent No.: US 7,169,228 B2
(45) Date of Patent: Jan. 30, 2007

(54) EXTRUSION APPLICATOR HAVING LINEAR MOTION OPERABILITY

(75) Inventor: Uwe Schneider, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/834,539

(22) Filed: Apr. 29, 2004

(65) Prior Publication Data

US 2005/0241575 A1 Nov. 3, 2005

(51) Int. Cl.
*B05C 5/00* (2006.01)

(52) U.S. Cl. ..... 118/325; 118/410

(58) Field of Classification Search ..... 425/382.4, 425/463; 239/556, 558, 559, 561, 566, 567, 239/568; 118/410, 419, 684, 257, 258, 315, 118/325; 156/167, 443, 440, 578
See application file for complete search history.

(56) References Cited

U.S. PATENT DOCUMENTS

| | | | | |
|---|---|---|---|---|
| 2,858,851 | A * | 11/1958 | Holl | 137/625.18 |
| 3,589,163 | A * | 6/1971 | Byrne et al. | 72/270 |
| 3,949,666 | A * | 4/1976 | Zimmer | 101/119 |
| 3,949,667 | A * | 4/1976 | Zimmer | 101/119 |
| 4,119,058 | A * | 10/1978 | Schmermund | 118/411 |
| 5,145,689 | A | 9/1992 | Allen et al. | |
| 6,464,785 | B1 | 10/2002 | Puffe | |
| 2002/0020768 | A1* | 2/2002 | Held et al. | 239/562 |
| 2004/0261696 | A1* | 12/2004 | Ackerman | 118/200 |

FOREIGN PATENT DOCUMENTS

| | | |
|---|---|---|
| EP | 0 367 985 A2 | 5/1990 |
| EP | 0 474 155 A2 | 3/1992 |

* cited by examiner

*Primary Examiner*—Brenda A. Lamb
(74) *Attorney, Agent, or Firm*—Jack L. Oney, Jr.; Adam J. Forman; Charles R. Ware

(57) ABSTRACT

An applicator for application of a substance onto a material. The applicator has a housing, a valve and a nozzle. The applicator may also have a journal that is connected to the valve which together translate in a linear motion to provide shuttering functionality. The valve may be circular or non-circular in shape. The applicator may extrude hot-melt onto a continuous web or drum.

In another embodiment, the applicator may have a housing and a valve. The applicator may also have a journal that is connected to the valve which translate together in a linear motion to profiled product application functionality and rotate together to provide shuttering functionality. The valve may be circular or non-circular in shape. The applicator may extrude hot-melt onto a continuous web or drum.

25 Claims, 22 Drawing Sheets

EXTRUSION APPLICATOR HAVING LINEAR MOTION OPERABILITY

FIELD OF THE INVENTION

The present invention relates to an applicator for application of a substance onto a material; for example, the applicator may apply a hot-melt substance onto a web of material, transfer drum or belt.

BACKGROUND OF THE INVENTION

Applicators for application of a substance onto a material are well known in the art. For instance, U.S. Pat. No. 5,145,689 discloses an applicator applying adhesive from slotted nozzles in which air is directed toward the medium that leads to swirling of the emerging adhesive threads. This prevents adhesive threads from tearing off and also prevents the formation of drops which could lead to a non-uniform application of adhesive. However, due to the needed supply of air, the applicator becomes complicated and expensive. Such an applicator finds frequent application where widths of material have to be laminated onto a substrate. To minimize the specific consumption of liquid medium and, at the same time, to ensure as uniform a distribution of the medium as possible, the medium is applied intermittently to achieve a grid-like application pattern. In order to enable, at the same time, a high transport speed of the width of material, the medium has to be applied in the direction of movement of the width of material at a high frequency. The grid points extend transversely to the direction of movement of the width of material and are arranged as closely as possible to one another.

In another example, EP 0 474155 A2 and EP 0 367985 A2 illustrate applicators where hole type nozzles are controlled by a pneumatically operated nozzle needle. However, the medium cannot be applied economically to the width of material when it moves at a high speed due to limited maximum cycle frequency of the nozzle units. This limitation is the result of the mass inertia of the nozzle needles and of the control elements.

In yet another example, U.S. Pat. No. 6,464,785 discloses an applicator which has a cylinder control slide that is rotatably operable to provide intermittent or continuous strands of a substance onto a web. However, this design is limited in its ability to quickly shutter the flow of said substance and to provide non-linear strand patterns.

What is needed is an applicator for application of a substance onto a material, wherein the applicator is able to quickly shutter the flow of said substance and is able to provide custom (e.g., non-linear) strand patterns.

SUMMARY OF THE INVENTION

An applicator for application of a substance onto a material. The applicator has a housing, valve and nozzle. The housing has at least one housing inlet for the introduction of the substance into the housing, and at least one housing channel for the distribution of the substance from the housing inlet, the housing channel being in fluid communication with the housing inlet. The valve has at least one valve channel for the further distribution of the substance, the valve channel being in fluid communication with the housing channel when the valve is in an open position, the valve channel not being in fluid communication with the housing channel when the valve is in a closed position, wherein the valve is translated in a linear motion to provide shuttering functionality. The housing also has at least one housing outlet for the distribution of the substance from the valve channel, the housing outlet being in fluid communication with the valve channel. The nozzle has at least one nozzle inlet for the introduction of the substance into the nozzle, the nozzle inlet being in fluid communication with the housing outlet, and at least one nozzle outlet for the extrusion of the substance onto the material, the nozzle outlet being in fluid communication with the nozzle inlet. The nozzle may also have at least one nozzle reservoir to provide manifold functionality of the substance, wherein the nozzle reservoir would be in fluid communication with the nozzle inlet and the nozzle outlet, the nozzle reservoir would be located between the nozzle inlet and the nozzle outlet.

The applicator may also have a journal, the journal being connected to the valve, the journal and the valve together translate in a linear motion to provide shuttering functionality. The valve may be circular or non-circular in shape.

The applicator may have at least two housing channels, the housing channels being symmetrically opposed such that a hot-melt supply force exerted on the valve is reduced.

The applicator may extrude hot-melt onto a continuous web, drum or belt.

In another embodiment, the applicator may have a housing and a valve. The housing may have at least one housing inlet for the introduction of the substance into the housing, and at least one housing channel for the distribution of the substance from the housing inlet, the housing channel being in fluid communication with the housing inlet. The valve may have at least one valve inlet for the further distribution of the substance, the valve inlet being in fluid communication with the housing channel, the valve inlet being in fluid communication with the housing channel when the valve is in an open position, the valve inlet not being in fluid communication with the housing channel when the valve is in a closed position, and at least one valve reservoir to provide manifold functionality of the substance, the valve reservoir being in fluid communication with the valve inlet, and at least one valve outlet for the extrusion of the substance onto the material, the valve outlet being in fluid communication with the valve reservoir.

The applicator may also have a journal, the journal being connected to the valve, the journal and the valve translate together in a linear motion to profiled product application functionality and rotate together to provide shuttering functionality.

BRIEF DESCRIPTION OF THE DRAWINGS

While the specification concludes with claims pointing out and distinctly claiming the present invention, it is believed the same will be better understood by the following drawings taken in conjunction with the accompanying specification wherein like components are given the same reference number.

DETAILED DESCRIPTION OF THE INVENTION

As used herein, the following terms have the following meanings:

The term "joined" encompasses configurations whereby an element is directly secured to another element by affixing the element directly to the other element, and configurations whereby an element is indirectly secured to another element by affixing the element to intermediate member(s) which in turn are affixed to the other element.

The term "longitudinal" refers to a direction running parallel to the maximum linear dimension of the article and includes directions within ±45° of the longitudinal direction. The "lateral" or "transverse" direction is orthogonal to the longitudinal direction. The "Z-direction" is orthogonal to both the longitudinal and transverse directions. The "x-y plane" refers to the plane congruent with the longitudinal and transverse directions.

The term "shuttering functionality" means to open and close, whether completely or partially.

The term "manifold functionality" means to supply a substance from a source location to a target location, wherein the target location has more channels/bores than the source location (e.g., from valve channel to outlet bores).

The term "profiled product application functionality" means to apply a substance onto a material in a continuous, non-linear pattern.

Figure 1:
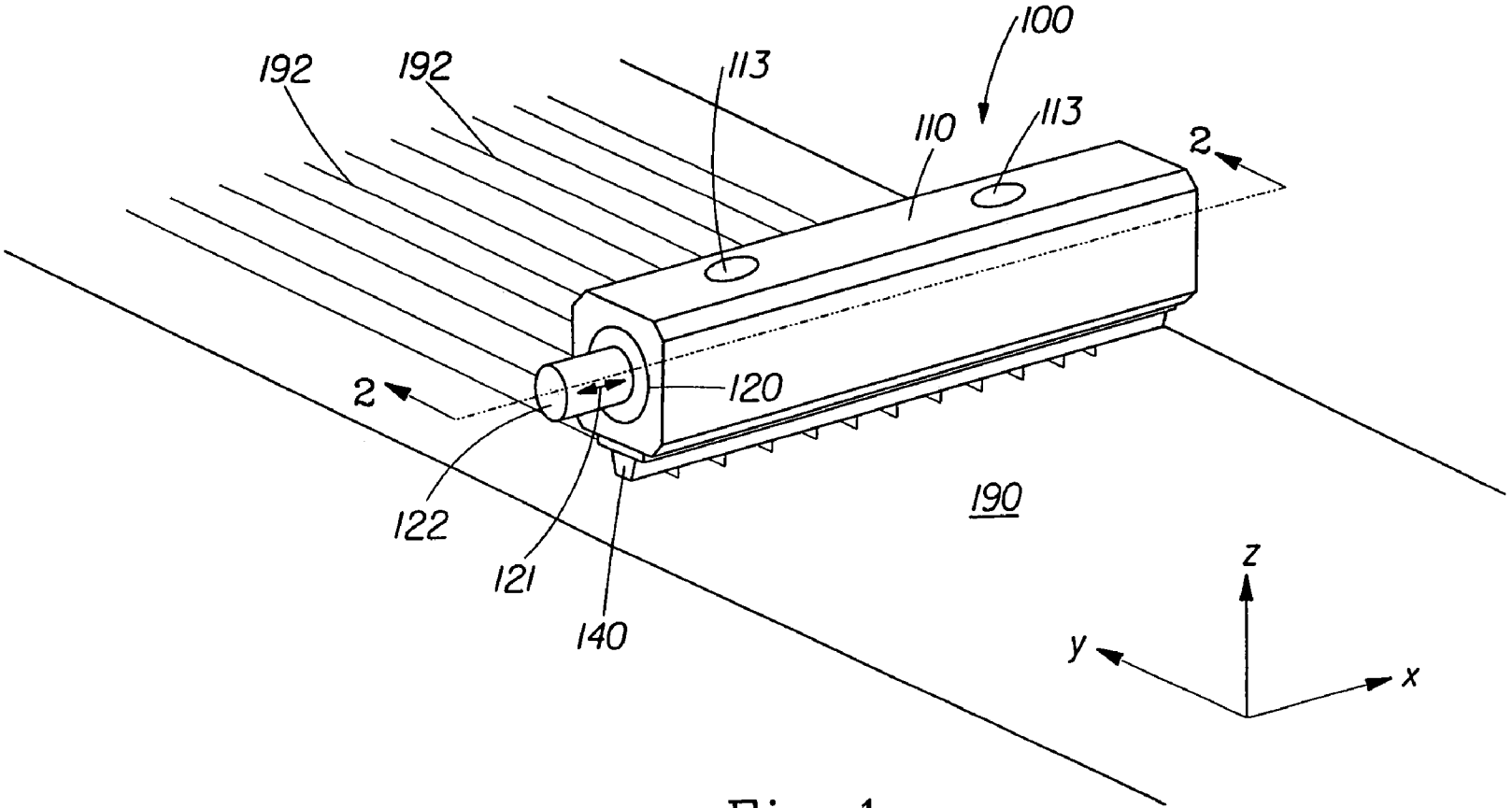
FIG. 1 is a perspective view of an exemplary, non-limiting embodiment of a hot-melt extrusion applicator in accordance with the present invention.

FIG. 1 is a perspective view of an exemplary, non-limiting embodiment of a hot-melt extrusion applicator 100 in accordance with the present invention. Applicator 100 includes a housing 110, valve 120 and a nozzle 140. While housing 110 is shown as an oblong, cubic support structure, said housing may be configured in a variety of shapes. Generally, housing 110 is provided with a selected width that will enable a desired width for product application. Housing 110 may also include at least one housing inlet 113 for the introduction and further processing of hot-melt 192. Valve 120 provides shuttering functionality. To provide such functionality, valve 120 may be translated in a linear motion as indicated by arrow 121. Said translation may be accomplished by providing a journal 122 having first and second ends, wherein said first end is connected to valve 120 and said second end is connected to an actuator (not shown) which provides said translational motion. When valve 120 is in an open position, hot-melt 192 flows out of nozzle 140 and onto a material 190 (e.g., moving web, transfer drum, belt or any other like device).

Figure 2A:
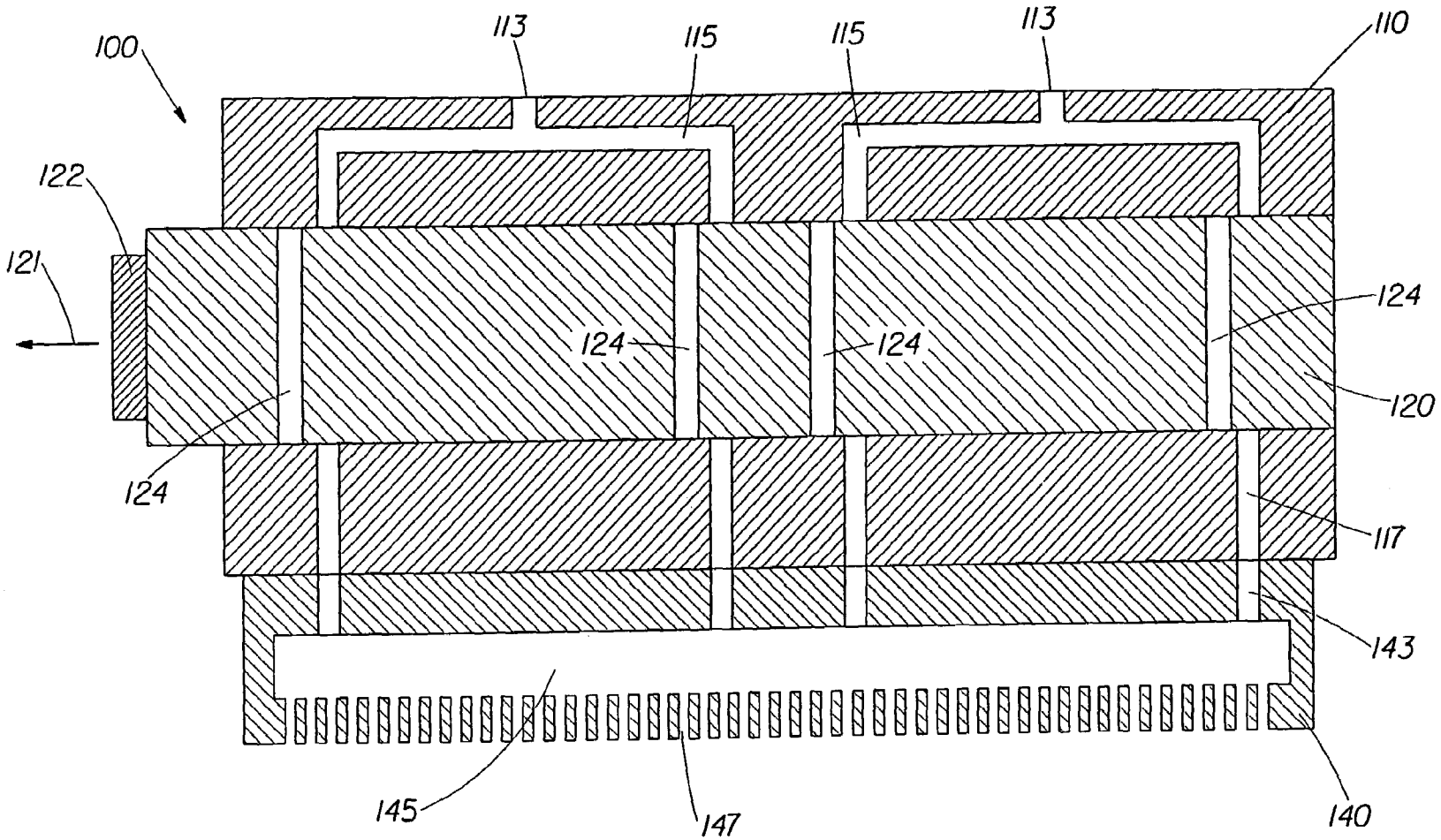
FIG. 2*a* is a cross-sectional view of the applicator from FIG. 1 taken along line 2—2 in a closed position.
Figure 2B:
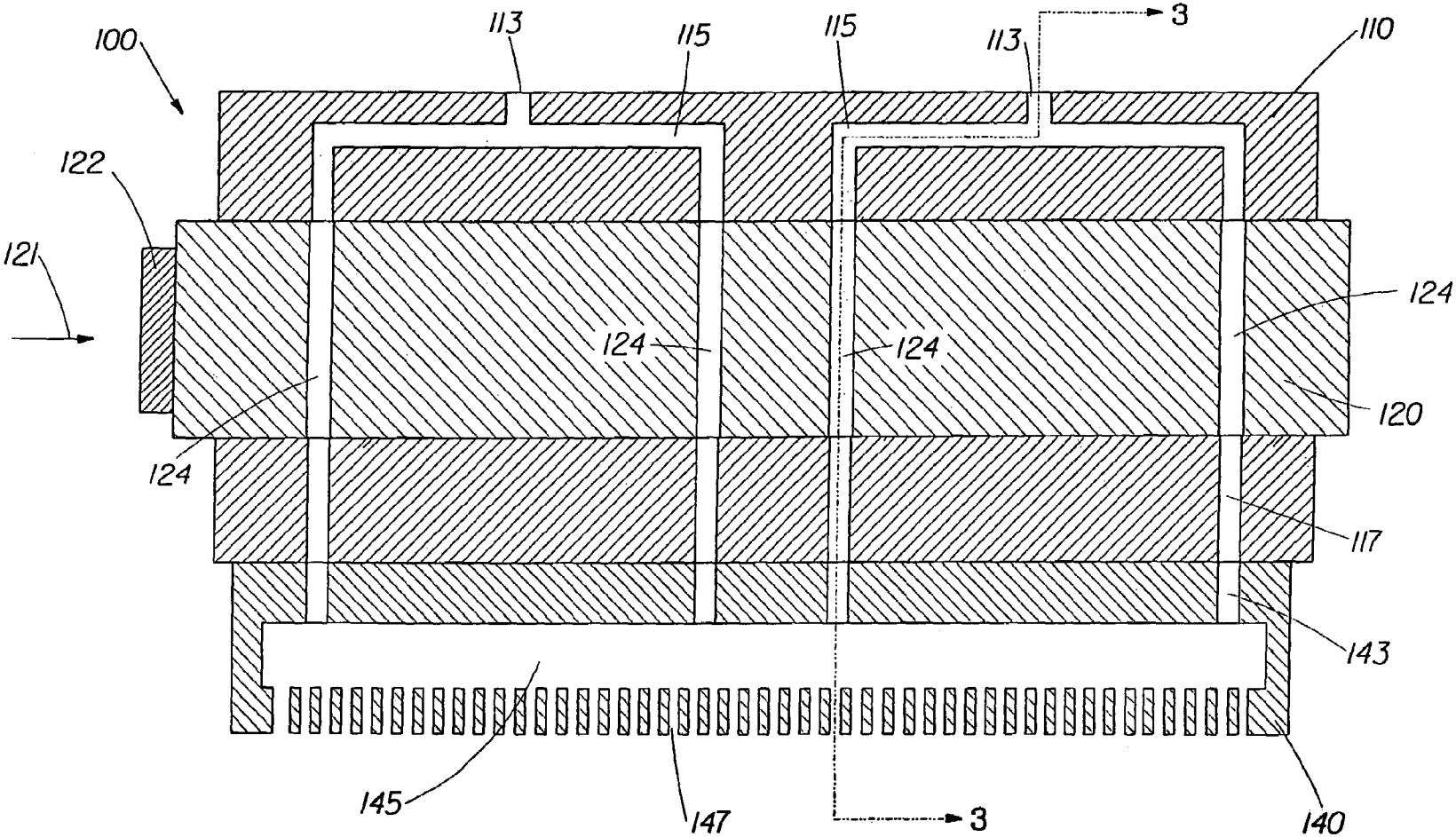
FIG. 2*b* is a cross-sectional view of the applicator from FIG. 1 taken along line 2—2 in an open position

FIG. 2*a* is a cross-sectional view of applicator 100 from FIG. 1 taken along line 2—2 in a closed position. Housing 110 is shown having at least one housing inlet 113 in which a hot-melt 192 (see FIG. 1) is supplied. Hot-melt 192 may be provided to said housing inlets using any suitable techniques for piping like substances. Housing inlets 113 may branch into housing channels 115. Housing channels 115 supply hot-melt 192 to valve 120. In this figure, valve 120 is shown in a closed position such that the flow of hot-melt 192 is obstructed from passing to nozzle 140. This closed position is accomplished by translating journal 122, which is connected to valve 120, in the direction of arrow 121. In contrast, FIG. 2*b* is a cross-sectional view of the applicator 100 from FIG. 1 taken along line 2—2 in an open position. In this figure, journal 122 and valve 120 have been translated in the direction of arrow 121 such that the flow of hot-melt 192 may pass to nozzle 140. More specifically, hot-melt passes through housing outlets 117, then into nozzle inlets 142, collects in nozzle reservoir 145 and then later discharged through nozzle outlets 147. Nozzle reservoir 145 may serve as a manifold to feed hot-melt 192 to nozzle outlets 147 in a substantially uniform manner. The dimensions and configuration of nozzle outlets 147 may be altered to achieve a particular product application pattern (e.g., larger outlet diameter for a larger product diameter).

Figure 3:
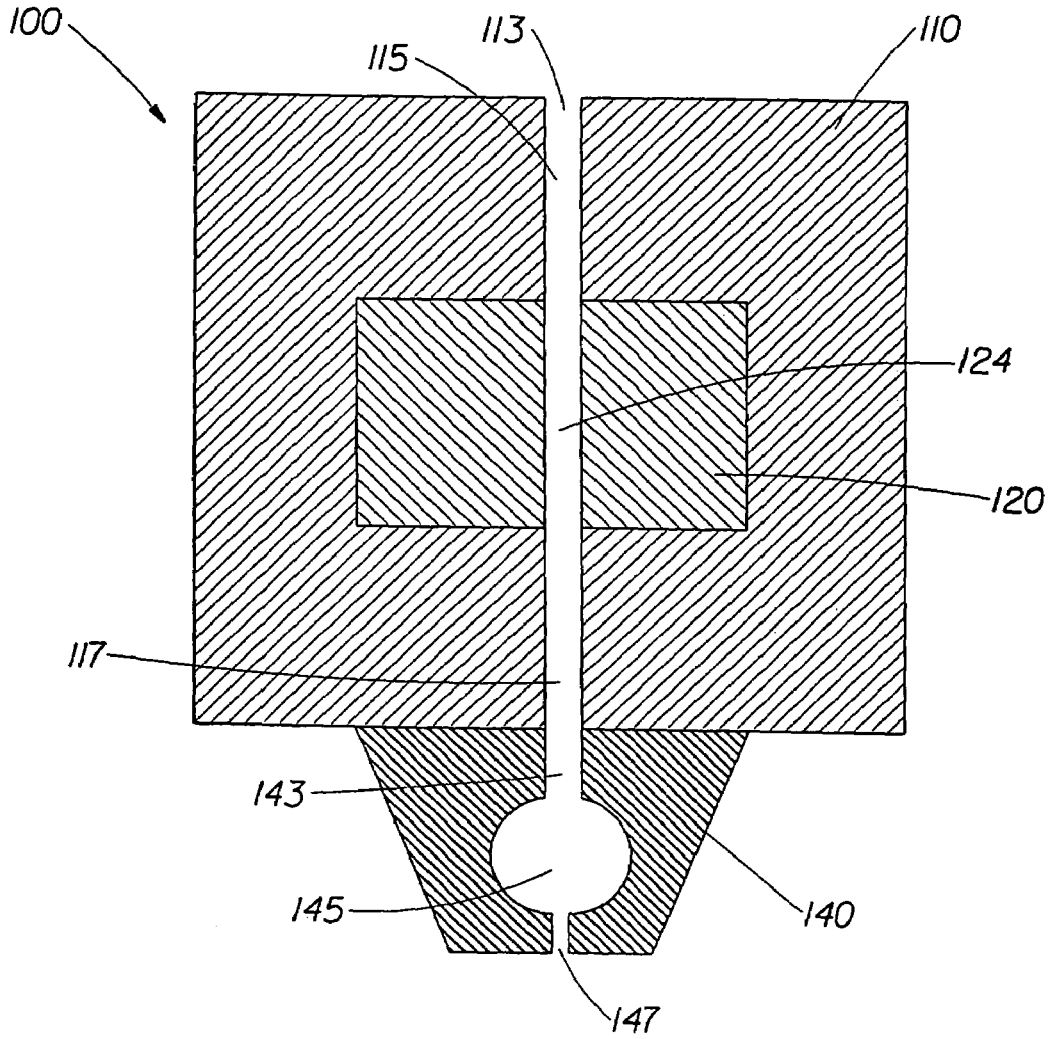
FIG. 3 is a cross-sectional view of the applicator from FIG. 2*b* taken along line 3—3 in an open position.

FIG. 3 is a cross-sectional view of applicator 100 from FIG. 2*b* taken along line 2—3 in an open position. Valve 120 is configured in a substantially rectangular shape. Because valve 120 in this particular embodiment is translated, rather than rotated, circular and non-circular shapes are both possible. Such non-circular shapes may provide particular benefits, such as, greater control in aligning the valve channels 124 with housing channels 115 (from above) and housing outlets 117 (from below).

Figure 4:
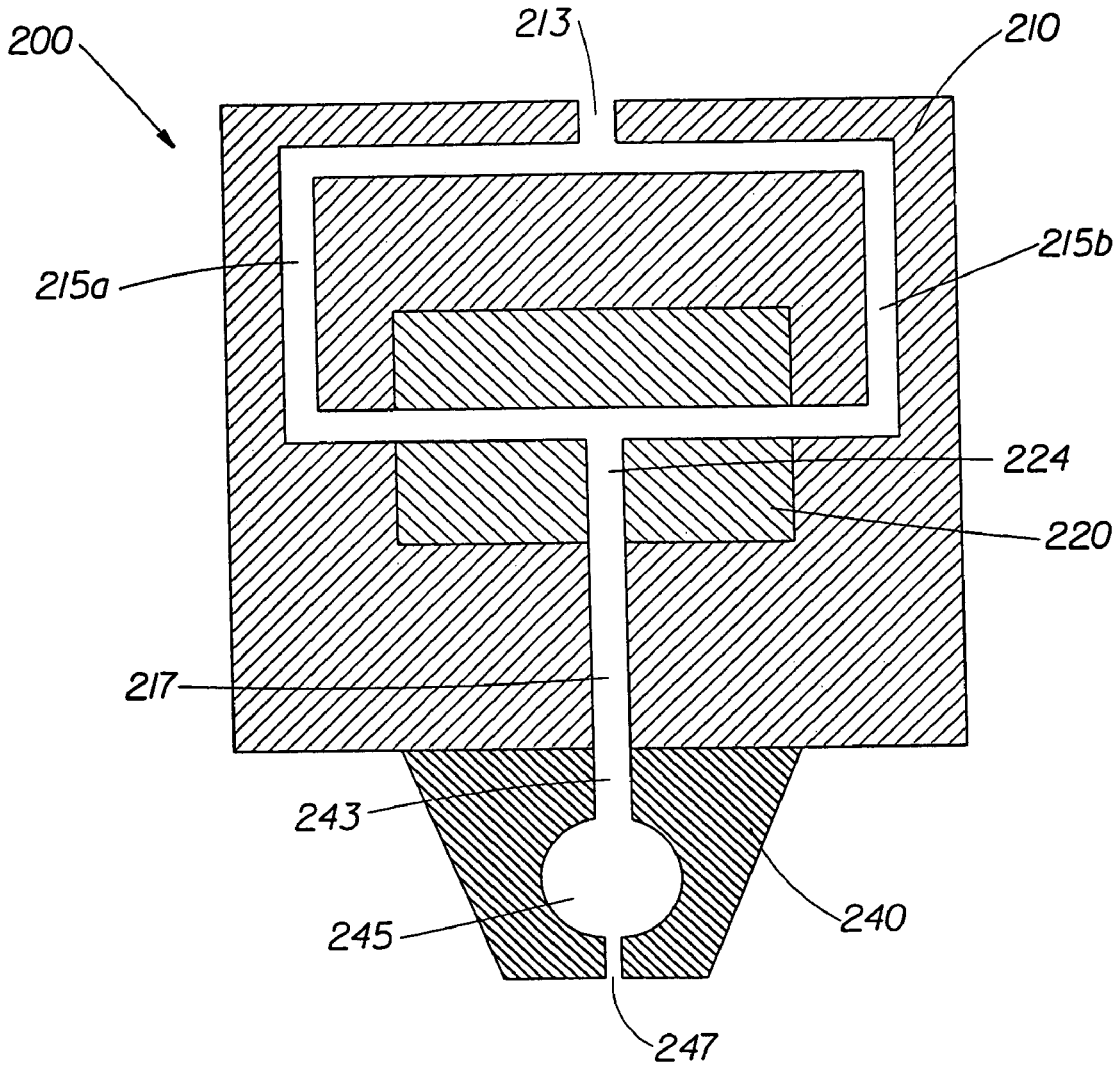
FIG. 4 is a cross-sectional view of another exemplary, non-limiting embodiment of an applicator in an open position.

Similar to FIG. 3, FIG. 4 is a cross-sectional view of another exemplary, non-limiting embodiment of an applicator 200 in an open position. Housing 210 is shown having at least one housing inlet 213 in which a hot-melt (not shown) is supplied. Said hot-melt may be provided to said housing inlets using any suitable techniques for piping like substances. Housing inlets 213 may branch into housing channels 215*a* and 215*b*. Housing channels 215*a* and 215*b* supply hot-melt to valve 220. Since housing channels 215*a* and 215*b* symmetrically supply (e.g., opposed at 180° angle) hot-melt to valve 220, the force and resulting pressure on valve 220 is reduced and thus improves valve 220 alignment and overall functionality. In this figure, valve 220 has been translated such that the flow of hot-melt may pass to nozzle 240. More specifically, hot-melt passes through housing outlets 217, then into nozzle inlets 242, collects in nozzle reservoir 245 and then later discharged through nozzle outlets 247. Nozzle reservoir 245 may serve as a manifold to feed the hot-melt to nozzle outlets 247 in a substantially uniform manner. The dimensions and configuration of nozzle outlets 247 may be altered to achieve a particular product application pattern (e.g., larger outlet diameter for a larger product diameter).

Figure 5:
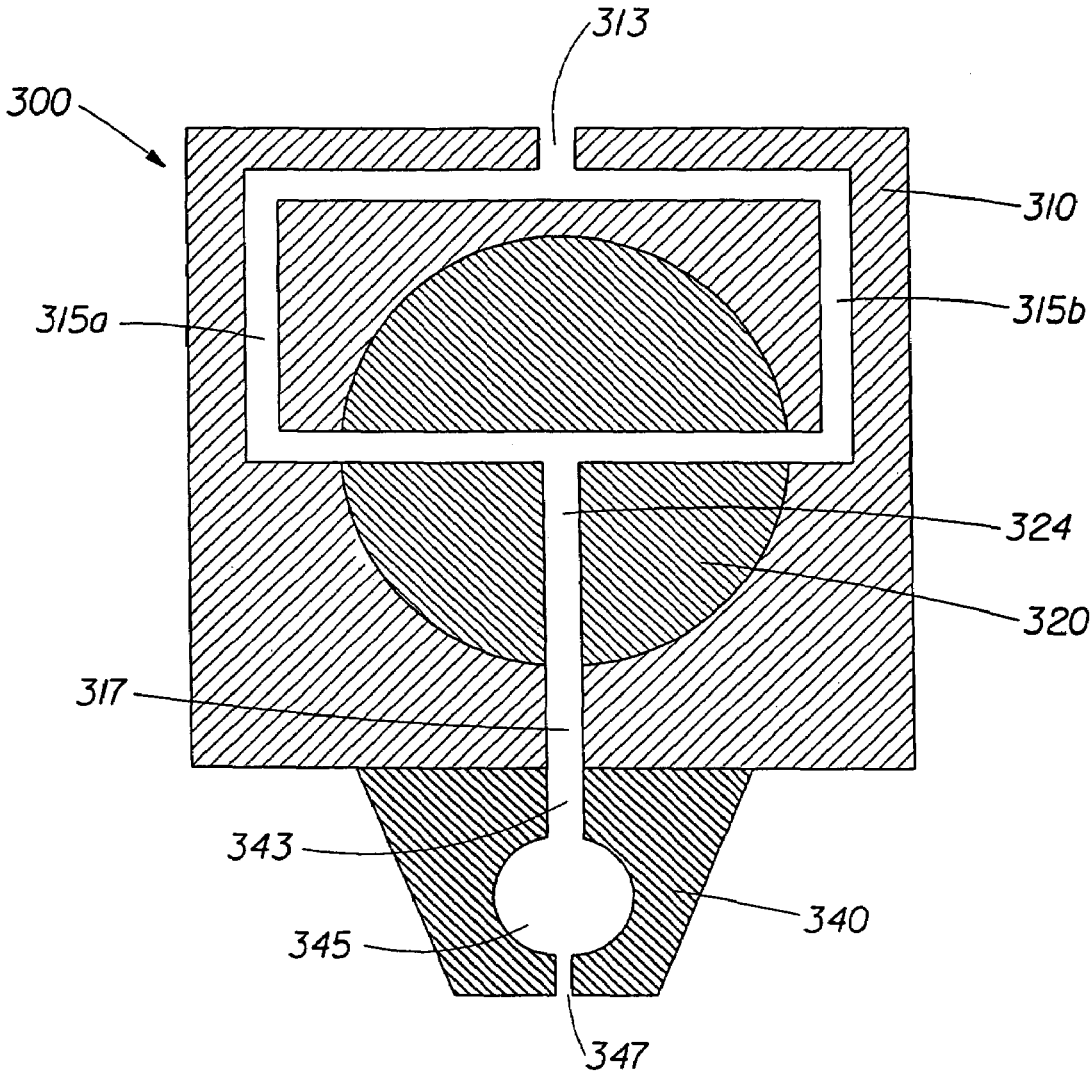
FIG. 5 is a cross-sectional view of yet another exemplary, non-limiting embodiment of an applicator in an open position.

Similar to FIG. 3, FIG. 5 is a cross-sectional view of yet another exemplary, non-limiting embodiment of an applicator 300 in an open position. Housing 310 is shown having at least one housing inlet 313 in which a hot-melt (not shown) is supplied. Said hot-melt may be provided to said housing inlets using any suitable techniques for piping like substances. Housing inlets 313 may branch into housing channels 315*a* and 315*b*. Housing channels 315*a* and 315*b* supply hot-melt to valve 320. Since housing channels 315*a* and 315*b* symmetrically supply (e.g., opposed at 180° angle) hot-melt to valve 320, the force and resulting pressure on valve 320 is reduced and thus improves valve 320 alignment and overall functionality. In this figure, valve 320 has been translated such that the flow of hot-melt may pass to nozzle 340. More specifically, hot-melt passes through housing outlets 317, then into nozzle inlets 342, collects in nozzle reservoir 345 and then later discharged through nozzle outlets 347. Nozzle reservoir 345 may serve as a manifold to feed the hot-melt to nozzle outlets 347 in a substantially uniform manner. The dimensions and configuration of nozzle outlets 347 may be altered to achieve a particular product application pattern (e.g., larger outlet diameter for a larger product diameter). Furthermore, in this embodiment, valve 320 is shown as having a substantially circular shape.

Figure 6:
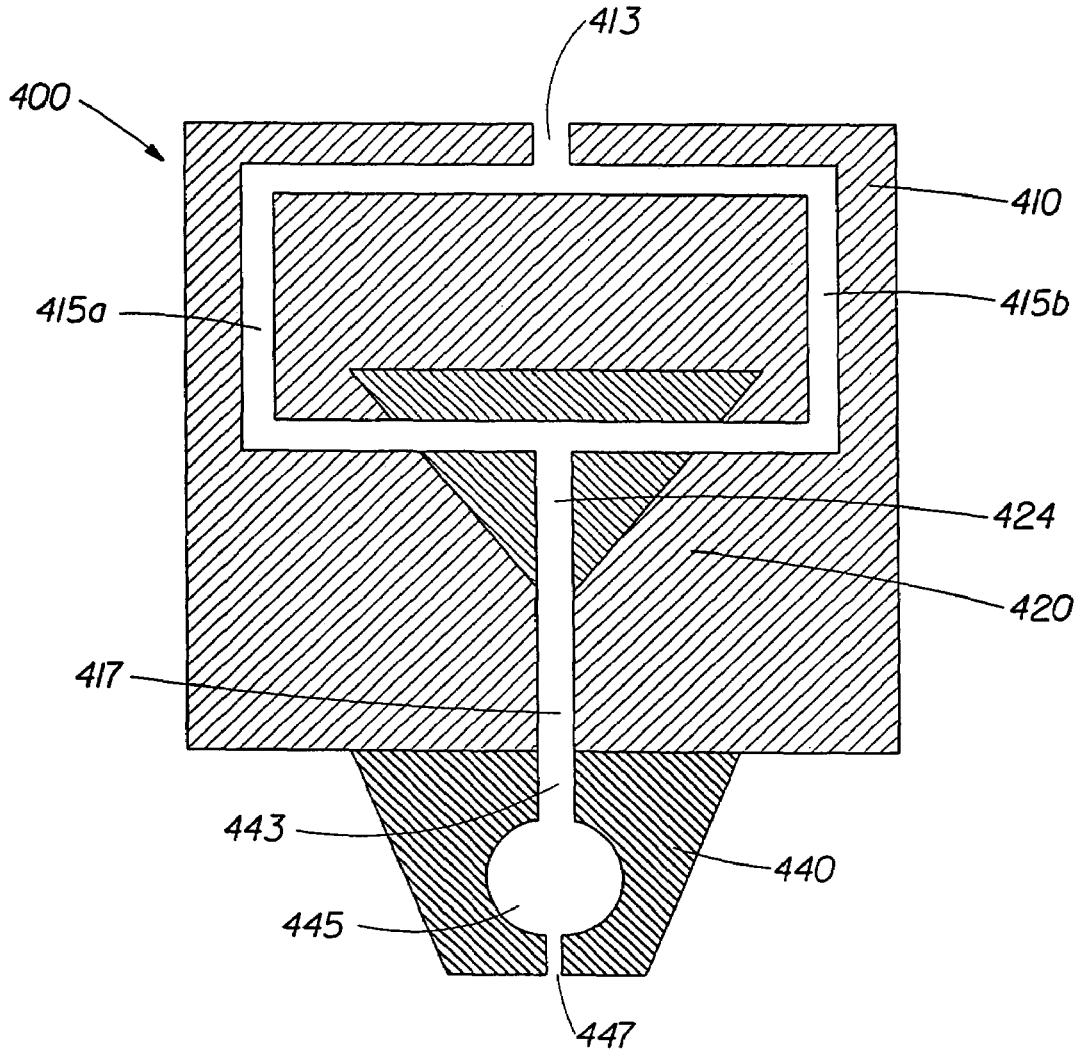
FIG. 6 is a cross-sectional view of yet another exemplary, non-limiting embodiment of an applicator in an open position.

Similar to FIG. 3, FIG. 6 is a cross-sectional view of yet another exemplary, non-limiting embodiment of an applicator 400 in an open position. Housing 410 is shown having at least one housing inlet 413 in which a hot-melt (not shown) is supplied. Said hot-melt may be provided to said housing inlets using any suitable techniques for piping like substances. Housing inlets 413 may branch into housing channels 415*a* and 415*b*. Housing channels 415*a* and 415*b* supply hot-melt to valve 420. Since housing channels 415*a* and 415*b* symmetrically supply (e.g., opposed at 180° angle) hot-melt to valve 420, the force and resulting pressure on valve 420 is reduced and thus improves valve 420 alignment and overall functionality. In this figure, valve 420 has been translated such that the flow of hot-melt may pass to nozzle 440. More specifically, hot-melt passes through housing outlets 417, then into nozzle inlets 442, collects in nozzle reservoir 445 and then later discharged through nozzle outlets 447. Nozzle reservoir 445 may serve as a manifold to feed the hot-melt to nozzle outlets 447 in a substantially uniform manner. The dimensions and configuration of nozzle outlets 447 may be altered to achieve a particular product application pattern (e.g., larger outlet diameter for a larger product diameter). Furthermore, in this embodiment, valve 420 is shown as having a substantially triangular shape. Such triangular shape may provide particular benefits, such as, greater control in aligning the valve channels 424 with housing channels 415*a* and 415*b* (from side) and housing outlets 417 (from below).

Figure 7:
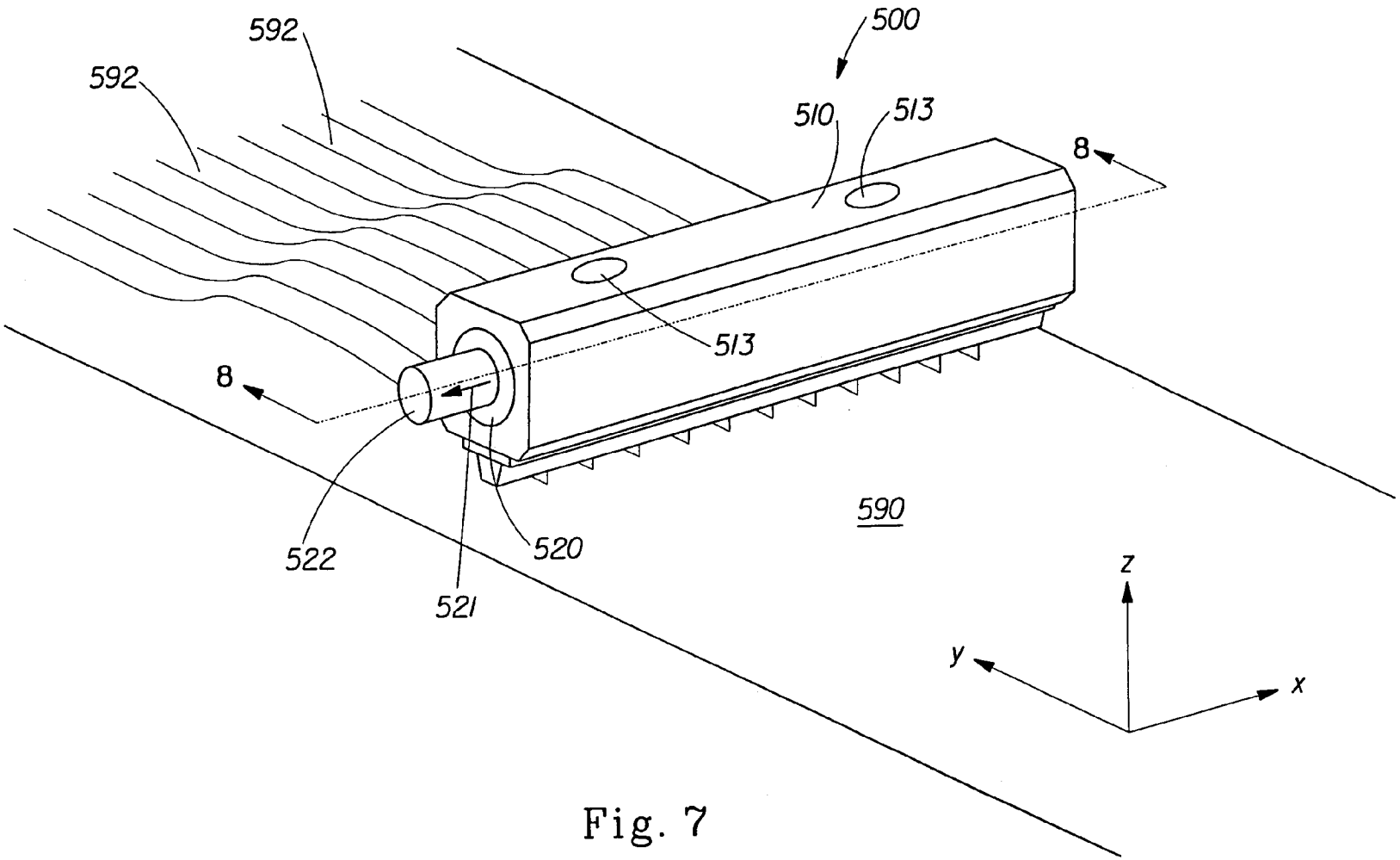
FIG. 7 is a perspective view of yet another exemplary, non-limiting embodiment of an applicator in accordance with the present invention.

FIG. 7 is a perspective view of yet another exemplary, non-limiting embodiment of an applicator 500 in accordance with the present invention. Applicator 500 includes a housing 510 and valve 520. While housing 510 is shown as an oblong, cubic support structure, said housing may be configured in a variety of shapes. Generally, housing 510 is provided with a selected width that will enable a desired width for product application. Housing 510 may also include at least one housing inlet 513 for the introduction and further processing of hot-melt 592. Valve 520 provides shuttering and profiled application functionalities. To provide such functionalities, valve 520 may be translated in a linear motion as indicated by arrow 521. Said translation may be accomplished by providing a journal 522 having first and second ends, wherein said first end is connected to valve 520 and said second end is connected to an actuator (not shown) which provides said translational motion. When valve 520 is in an open position, hot-melt 592 flows directly out of said valve and onto a material 590 (e.g., moving web, transfer drum, belt or any other like device).

Figure 8A:
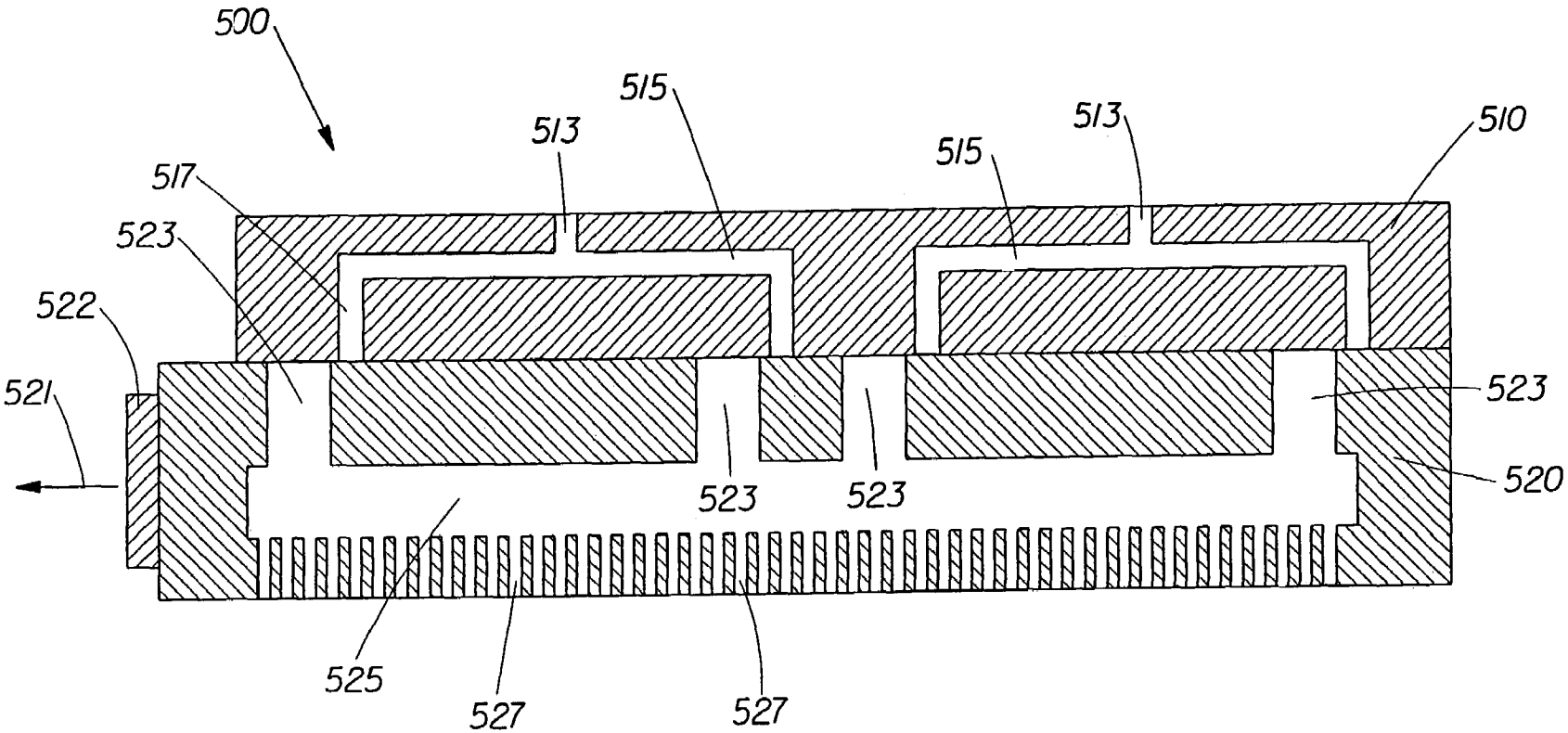
FIG. 8*a* is a cross-sectional view of applicator from FIG. 7 taken along line 8—8 in a closed position.
Figure 8B:
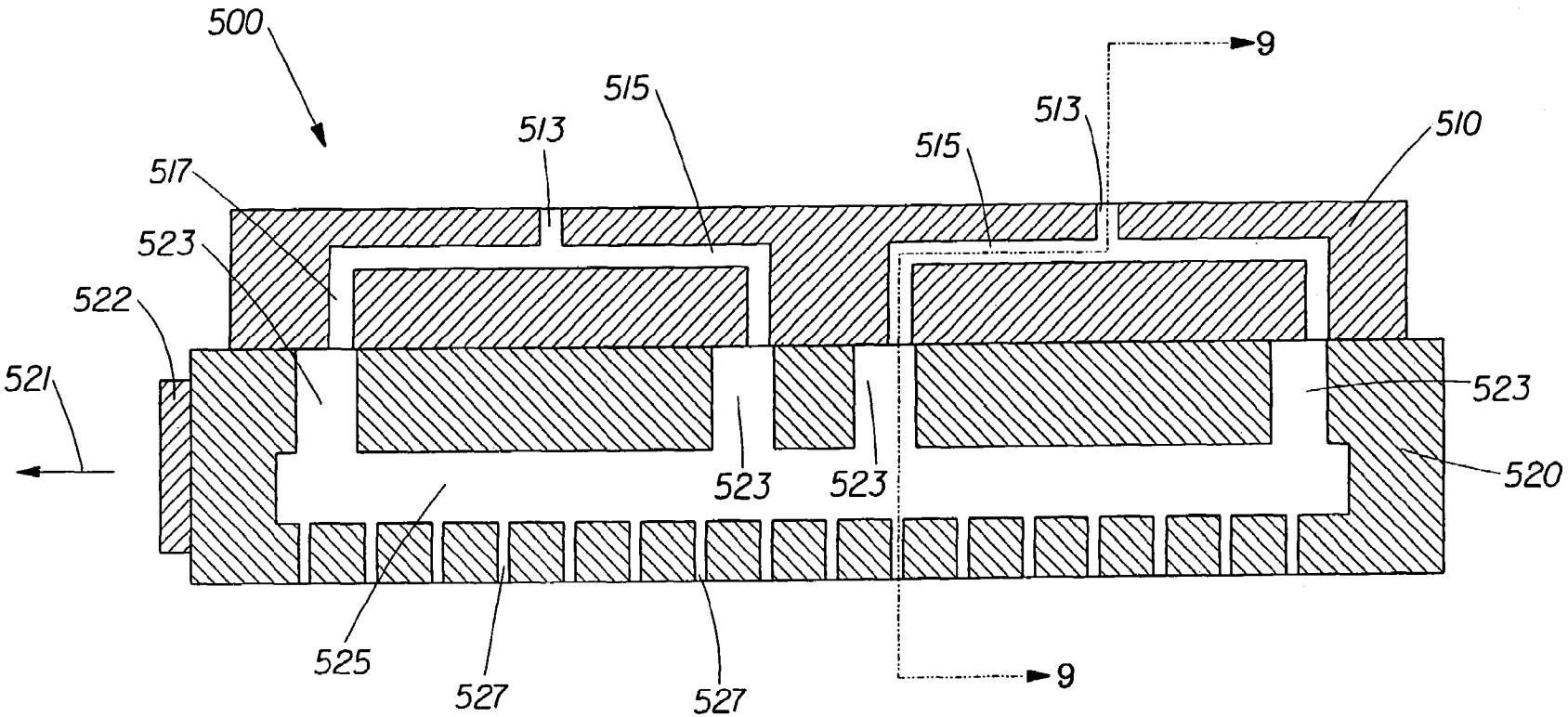
FIG. 8*b* is a cross-sectional view of the applicator from FIG. 1 taken along line 8—8 in a first open position.
Figure 8C:
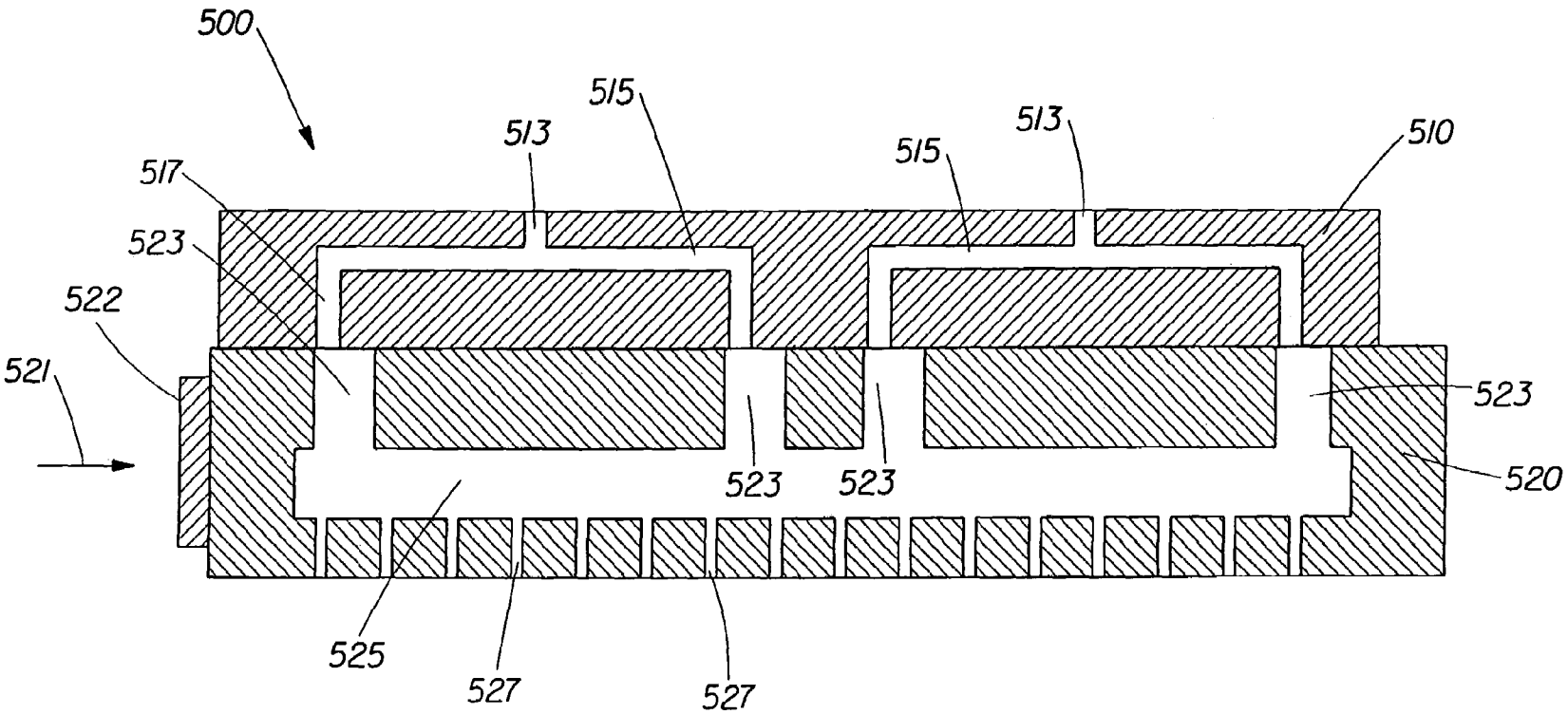
FIG. 8*c* is a cross-sectional view of the applicator from FIG. 1 taken along line 8—8 in a second open position.

FIG. 8*a* is a cross-sectional view of applicator 500 from FIG. 7 taken along line 8—8 in a closed position. Housing 510 may have least one housing inlet 513 (two inlets shown) in which a hot-melt 592 (see FIG. 7) is supplied. Hot-melt 592 may be provided to said housing inlets using any suitable techniques for piping like substances. Housing inlets 513 may branch into housing channels 515. Housing channels 515 supply hot-melt 592 to valve 520. In this figure, valve 520 is shown in a closed position such that the flow of hot-melt 592 is obstructed from passing through said valve. This closed position is accomplished by translating journal 522, which is connected to valve 520, in the direction of arrow 521. In contrast, FIGS. 8*b* and 8*c* are cross-sectional views of the applicator 500 from FIG. 1 taken along line 8—8 in a first and second open position, respectively. Referring now to FIG. 8*b*, a journal 522 and valve 520 have been translated in the direction of arrow 521 such that the flow of hot-melt 592 may pass through said valve. More specifically, hot-melt passes through housing outlets 517, then into valve inlets 523, collects in valve reservoir 525 and then later discharged through valve outlets 527. Valve reservoir 525 may serve as a manifold to feed hot-melt 592 to valve outlets 527 in a substantially uniform manner. The dimensions and configuration of valve outlets 527 may be altered to achieve a particular product application pattern (e.g., larger outlet diameter for a larger product diameter). Referring now to FIG. 8*c*, journal 522 and valve 520 have been further translated in the direction of arrow 521 such that the flow of hot-melt 592 may still pass through said valve, however, the hot-melt application itself is also translated. In this way, a profiled application (e.g., curved) is achievable. Furthermore, the absence of a nozzle (like nozzle 140 from FIG. 1) allows for immediate shuttering functionality (e.g., when valve 520 is closed, less hot-melt is discharged than that of the configuration of FIG. 1).

Figure 9:
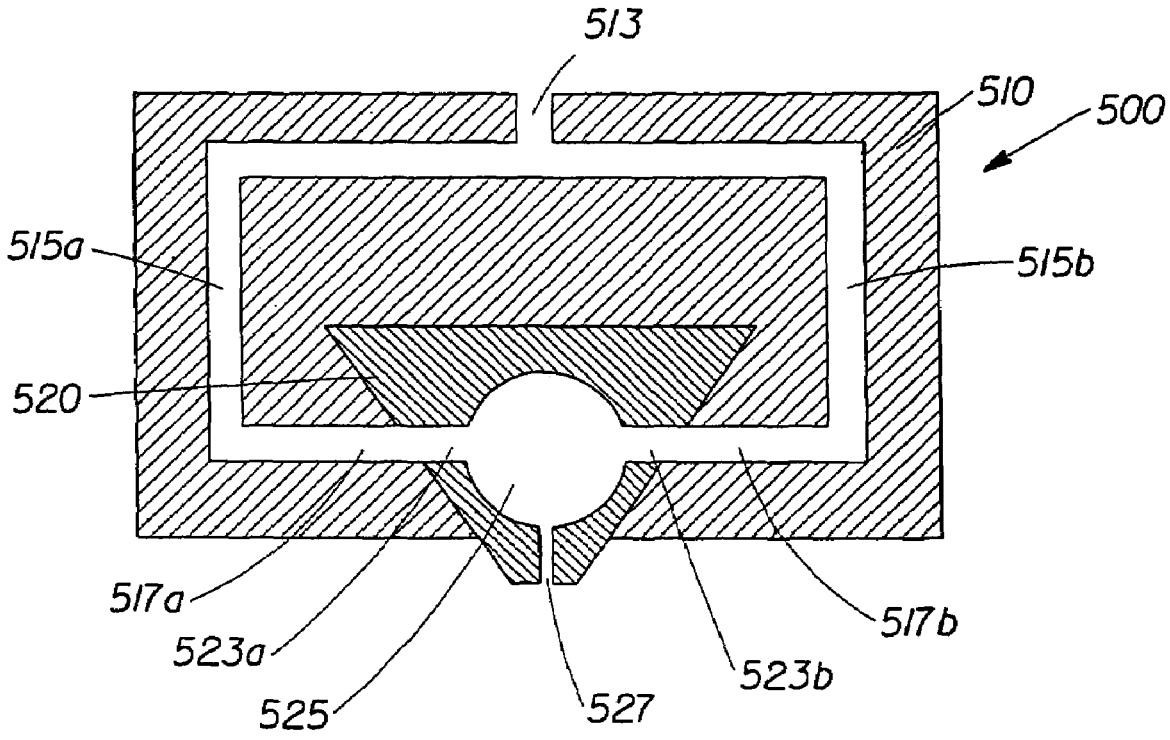
FIG. 9 is a cross-sectional view of the applicator from FIG. 8*b* taken along line 9—9 in an open position.

FIG. 9 is a cross-sectional view of applicator 500 from FIG. 8*b* taken along line 9—9 in an open position. Valve 520 is configured in a substantially triangular shape. Because valve 520 in this particular embodiment is translated, rather than rotated, circular and non-circular shapes are both possible. Such non-circular shapes may provide particular benefits, such as, greater control in aligning the valve channels 523*a* and 523*b* with housing channels 517*a* and 517*b* (from side) and valve outlets 527 (from below).

Figure 10:
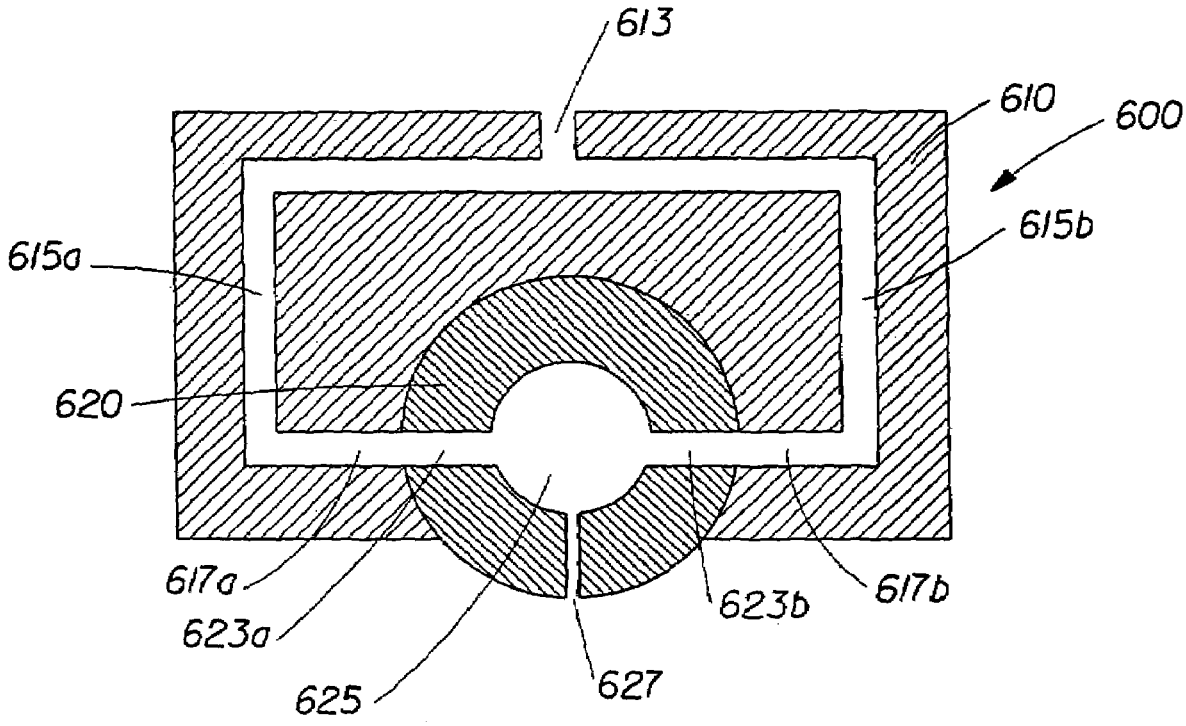
FIG. 10 is a cross-sectional view of yet another exemplary, non-limiting embodiment of an applicator in an open position.

Similar to FIG. 9, FIG. 10 is a cross-sectional view of yet another exemplary, non-limiting embodiment of an applicator 600 in an open position. Housing 610 is shown having at least one housing inlet 613 in which a hot-melt (not shown) is supplied. Said hot-melt may be provided to said housing inlets using any suitable techniques for piping like substances. Housing inlets 613 may branch into housing channels 615*a* and 615*b*. Housing channels 615*a* and 615*b* supply hot-melt to valve 620. Since housing channels 615*a* and 615*b* symmetrically supply (e.g., opposed at 180° angle) hot-melt to valve 620, the force and resulting pressure on valve 620 is reduced and thus improves valve 620 alignment and overall functionality. In this figure, valve 620 has been translated such that the flow of hot-melt may pass through said valve. More specifically, hot-melt passes through housing outlets 617*a* and 617*b*, then into valve inlets 623*a* and 623*b*, collects in valve reservoir 625 and then later discharged through valve outlets 627. Valve reservoir 625 may serve as a manifold to feed the hot-melt to valve outlets 627 in a substantially uniform manner. The dimensions and configuration of valve outlets 627 may be altered to achieve a particular product application pattern (e.g., larger outlet diameter for a larger product diameter). Furthermore, in this embodiment, valve 620 is shown as having a substantially circular shape.

Figure 11:
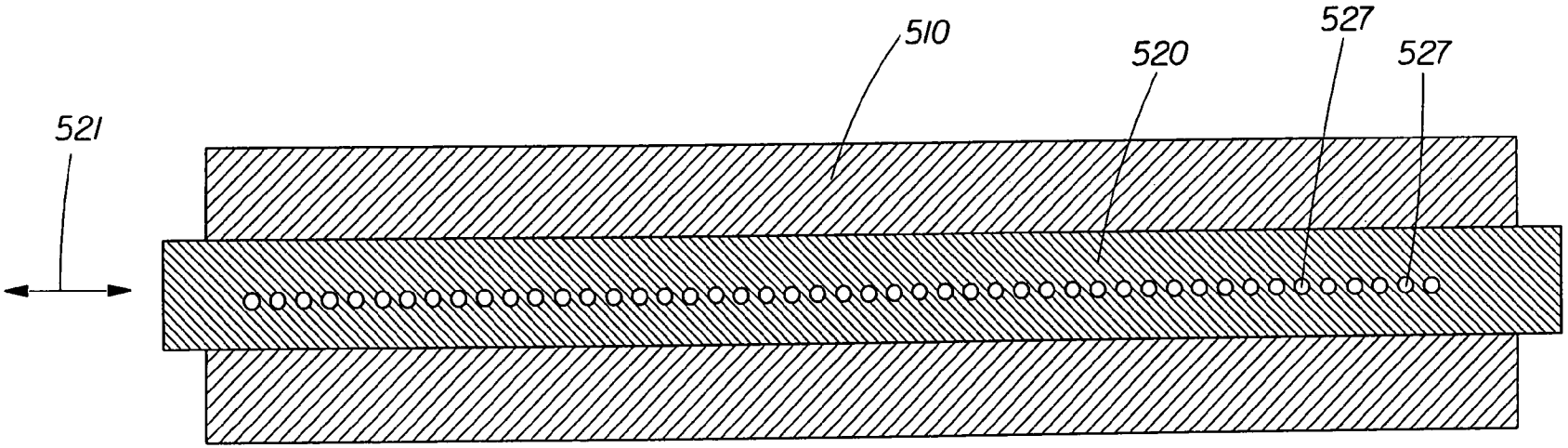
FIG. 11 is a bottom view of the applicator from FIG. 9.

FIG. 11 is a bottom view of applicator 500 from FIG. 9. Valve 520 may be translated in either direction as indicated by arrow 521 in order to provide profiled applications of hot-melt. While a single row of valve outlets 527 are shown, one skilled in the art would appreciate that the number of outlets, spacing between said outlets, diameter of said outlets, number of rows of outlets, and any other like characteristics may be altered to achieve a desired product application.

Figure 12A:
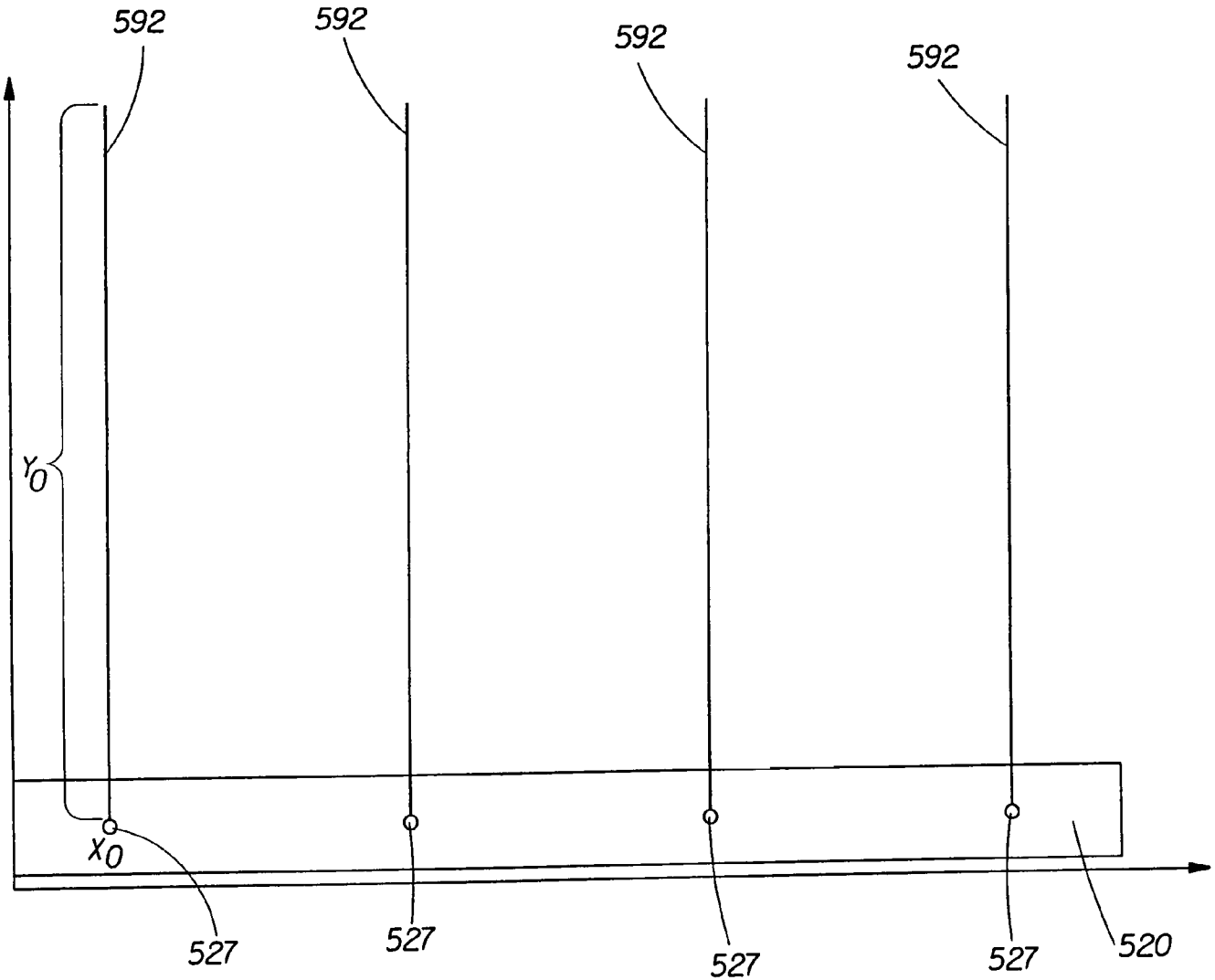
FIG. 12*a* is a schematic, bottom view of the applicator from FIG. 9 showing a valve at an initial position $X_0$, wherein a valve outlet has a corresponding hot-melt product application identified as $Y_0$.
Figure 12B:
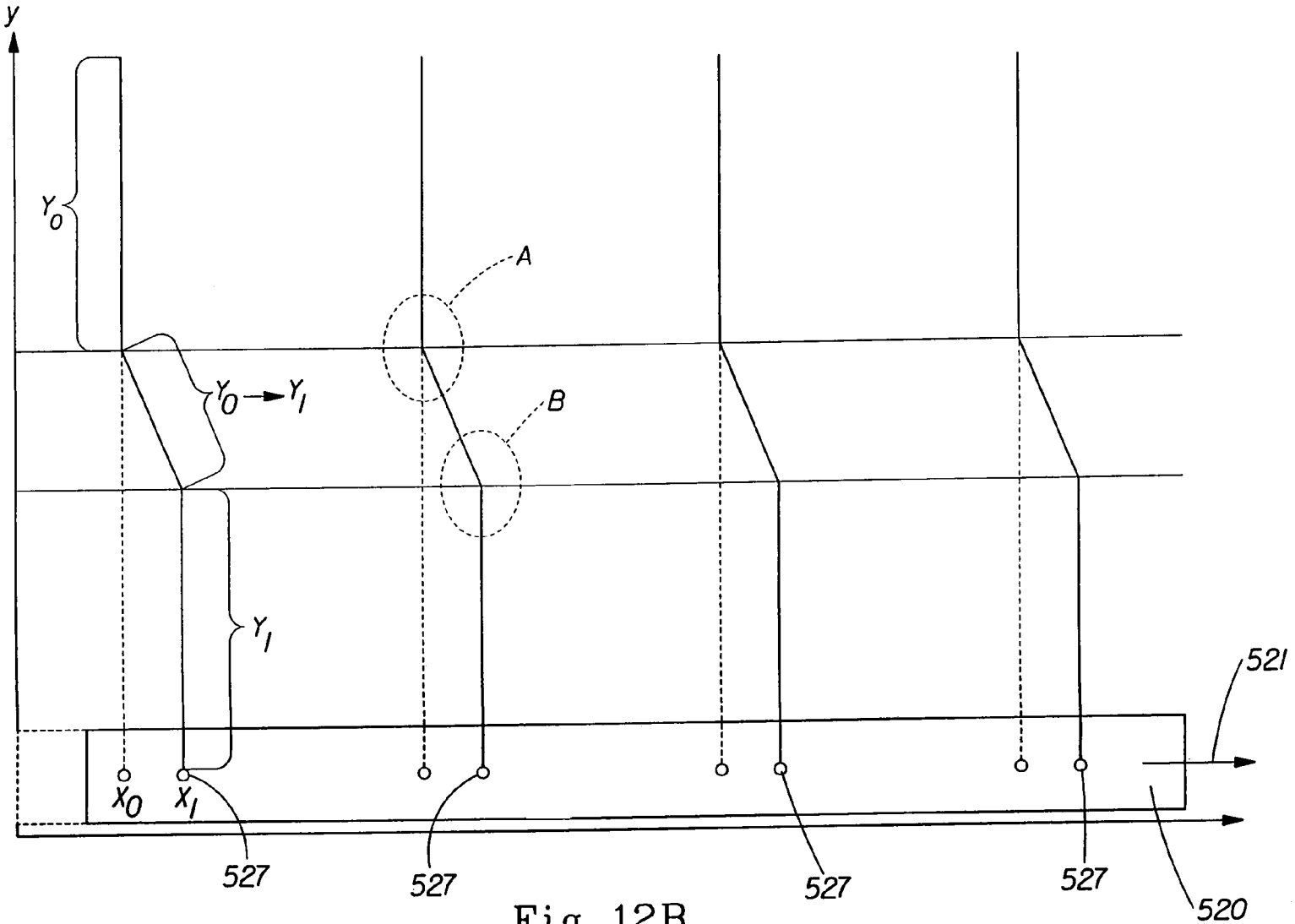
FIG. 12*b* is a schematic, bottom view of the applicator from FIG. 9 showing a valve at a new position $X_1$, wherein a valve outlet has a corresponding hot-melt product application identified as $Y_1$.
Figure 12C:
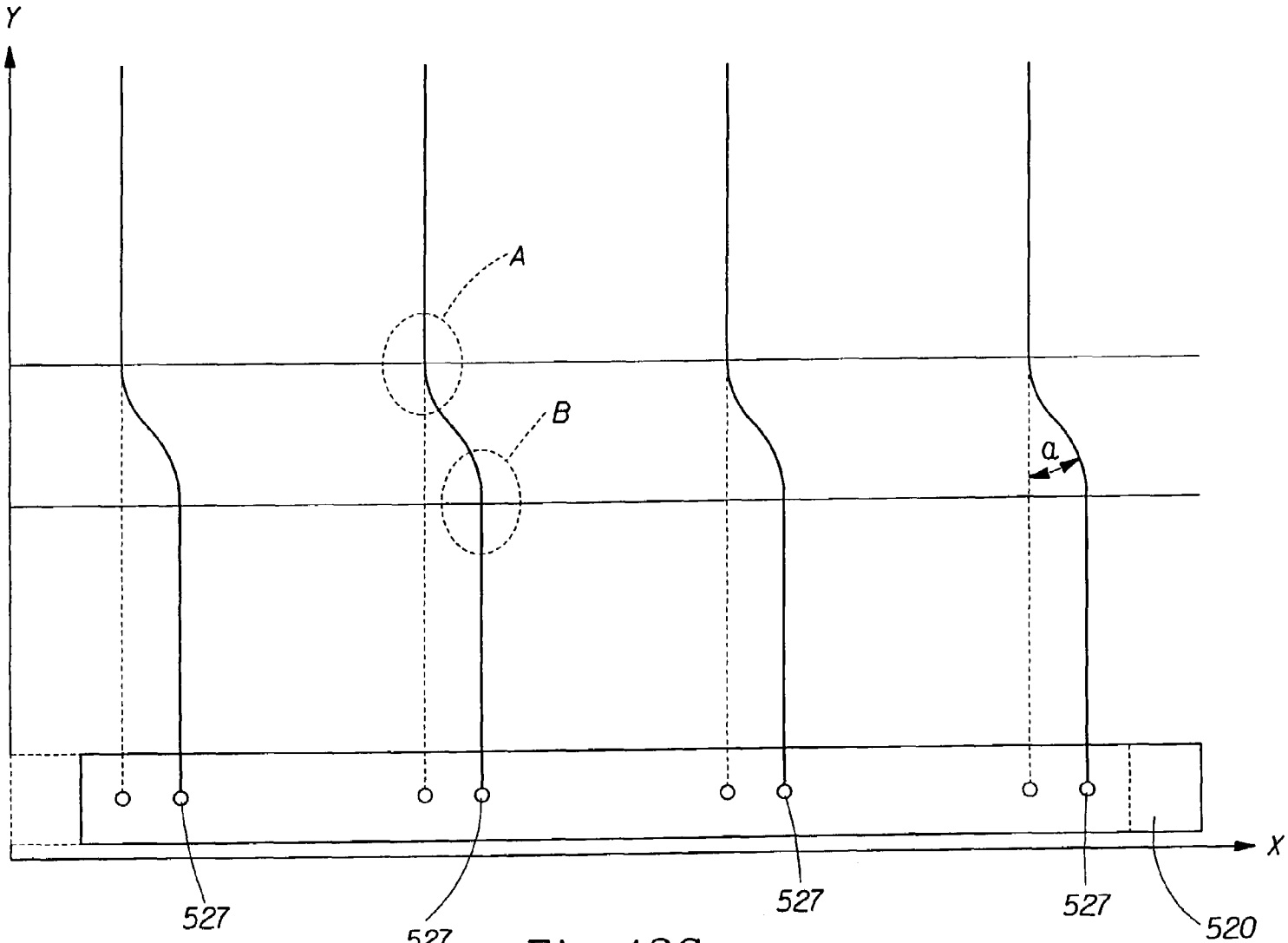
FIG. 12*c* shows the schematic, bottom view from FIG. 12*b* with highlighted, encircled regions A and B to illustrate a smoother transitional region.

Referring now to FIGS. 12*a*–12*c*, a series of schematic, bottom views of applicator 500 along with an x-y axis for illustrative purposes are shown. FIG. 12*a* shows valve 520 at an initial position $X_0$, wherein a valve outlet 527 has a corresponding hot-melt 592 product application identified as $Y_0$. FIG. 12*b* shows valve 520 being translated, as indicated by arrow 521, to a new position $X_1$ wherein said valve outlet 527 has a corresponding hot-melt 592 product application identified as $Y_1$. During said translation, the hot-melt product application creates an intermediate zone of application identified as $Y_0 \rightarrow Y_1$. After said translation occurs, a profiled application of hot-melt is achieved. Referring now to encircled regions A and B in FIG. 12*b*, the transitional regions are shown to be angular in nature. In contrast, referring now to encircled regions A and B in FIG. 12*c*, the transitional regions are shown to be smoother in nature. A smoothly accelerated motion of valve outlets 527 will result in a smoother (e.g., curved) pattern rather than an angular pattern. Also shown in FIG. 12*c*, is a transitional angle ($\alpha$) which is heavily dependant on material 590 web speed in the y-direction (see FIG. 7), valve 520 speed in the x-direction (see FIG. 7) and the length (L) of hot-melt 592 from the valve outlet 527 to material 590 (see FIG. 13).

Figure 13:
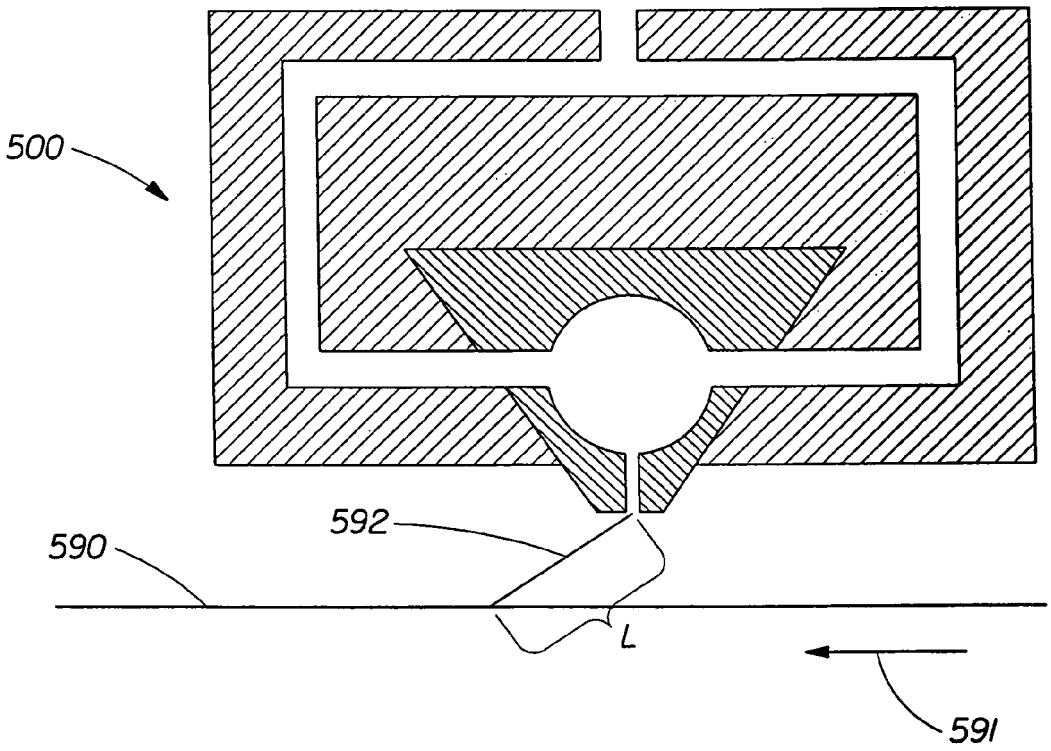
FIG. 13 is a schematic, side elevation of the applicator from FIG. 9, wherein a substance is applied to a moving web of material.
Figure 14:
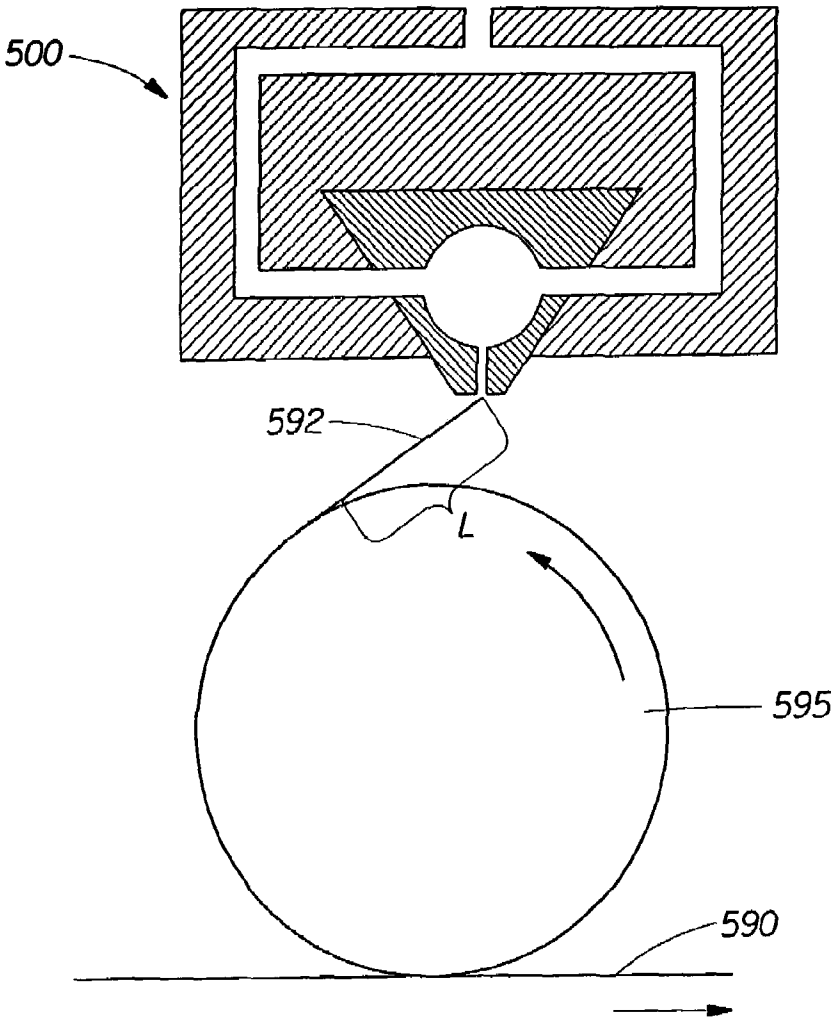
FIG. 14 is a schematic, side elevation of the applicator from FIG. 9, wherein a substance is applied to a transfer drum.

Referring now to FIG. 13, when length (L) is equal to substantially zero, any translation of valve outlet 527 in the x-direction will cause the application of hot-melt 592 onto the material 590 to translate approximately the same distance. Further, when length (L) is equal to substantially zero, steep transitional angles ($\alpha$) are more easily achieved. In contrast, as length (L) becomes longer, transitional angles ($\alpha$) will become shallower because since the hot-melt has to travel from the valve outlet 527 to material 590 before the full translation in the x-direction is reflected in the hot-melt product application. In order to minimize length (L) and to permit the application of high temperature hot-melt 592 without damaging material 590, said hot-melt may be first extruded onto a chill drum 595 and then subsequently transferred to material 590 using known transfer techniques (see FIG. 14).

Figure 15:
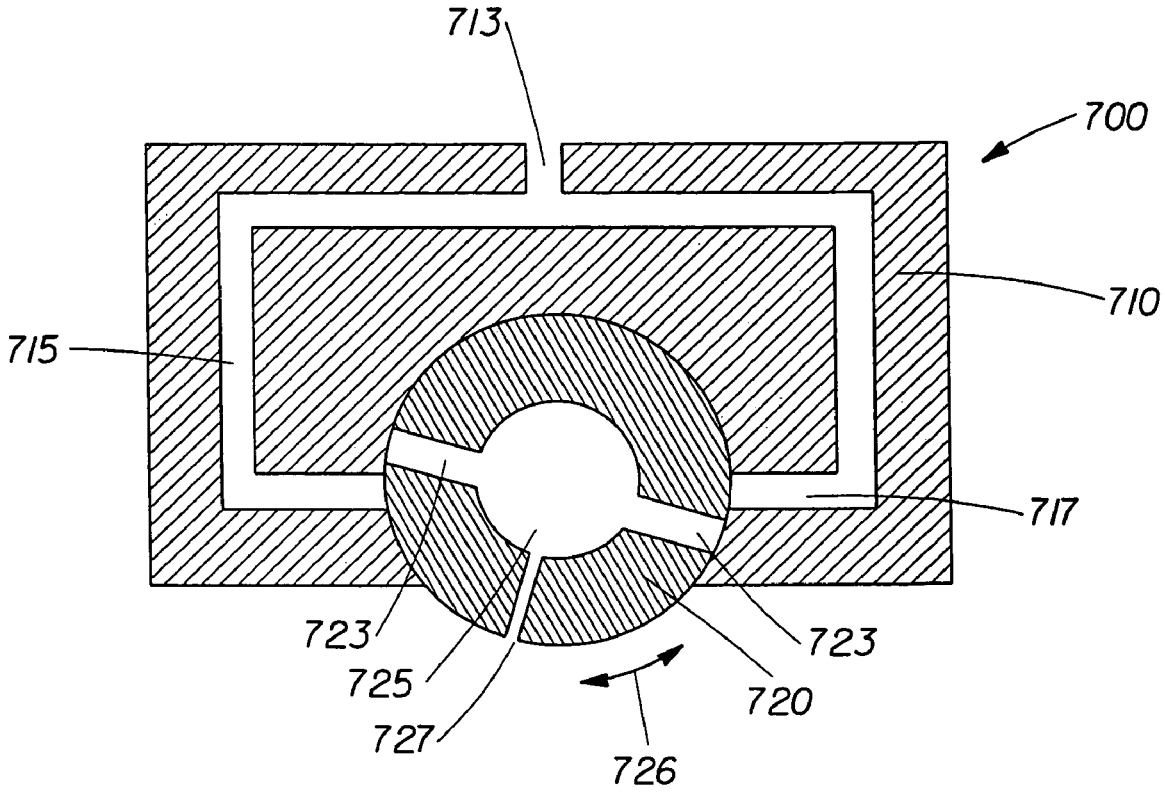
FIG. 15 is a cross-sectional view of yet another exemplary, non-limiting embodiment of an applicator, wherein the valve may be translated linearly to provide a profiled product application and rotated to provide shuttering functionality.

Similar to the view of FIG. 10, FIG. 15 is a cross-sectional view of yet another exemplary, non-limiting embodiment of an applicator 700 in accordance with the present invention. Applicator 700 includes a housing 710 and valve 720. While housing 710 is shown as an oblong, cubic support structure, said housing may be configured in a variety of shapes. Generally, housing 710 is provided with a selected width that will enable a desired width for product application. Housing 710 may also include at least one housing inlet 713 for the introduction and further processing of hot-melt (not shown). Valve 720 provides shuttering and profiled application functionalities. To provide such shuttering functionality, valve 720 rotates within housing 710 as indicated by arrow 726. To provide such profiled application functionality, valve 720 may be translated in a linear motion in and out of the page. Said translation may be accomplished by providing a journal (not shown) having first and second ends, wherein said first end is connected to valve 720 and said second end is connected to an actuator (not shown) which provides said translational motion. When valve 720 is in an open position, hot-melt flows directly out of said valve and onto a material (e.g., moving web, transfer drum, belt or any other like device).

More specifically, housing 710 may have least one housing inlet 713 in which a hot-melt is supplied. Said hot-melt may be provided to said housing inlets using any suitable techniques for piping like substances. Housing inlets 713 may branch into housing channels 715*a* and 715*b*. Housing channels 715 supply hot-melt to valve 720. In this figure, valve 720 is shown in a closed position such that the flow of hot-melt is obstructed from passing through said valve. This closed position is accomplished by rotating a journal (not shown), which is connected to valve 720, in the direction of arrow 726. When valve 720 is opened, hot-melt passes through housing outlets 717, then into valve inlets 723, collects in valve reservoir 725 and then later discharged through valve outlets 727. Valve reservoir 725 may serve as a manifold to feed hot-melt to valve outlets 727 in a substantially uniform manner. The dimensions and configuration of valve outlets 727 may be altered to achieve a particular product application pattern (e.g., larger outlet diameter for a larger product diameter).

Figure 16A:
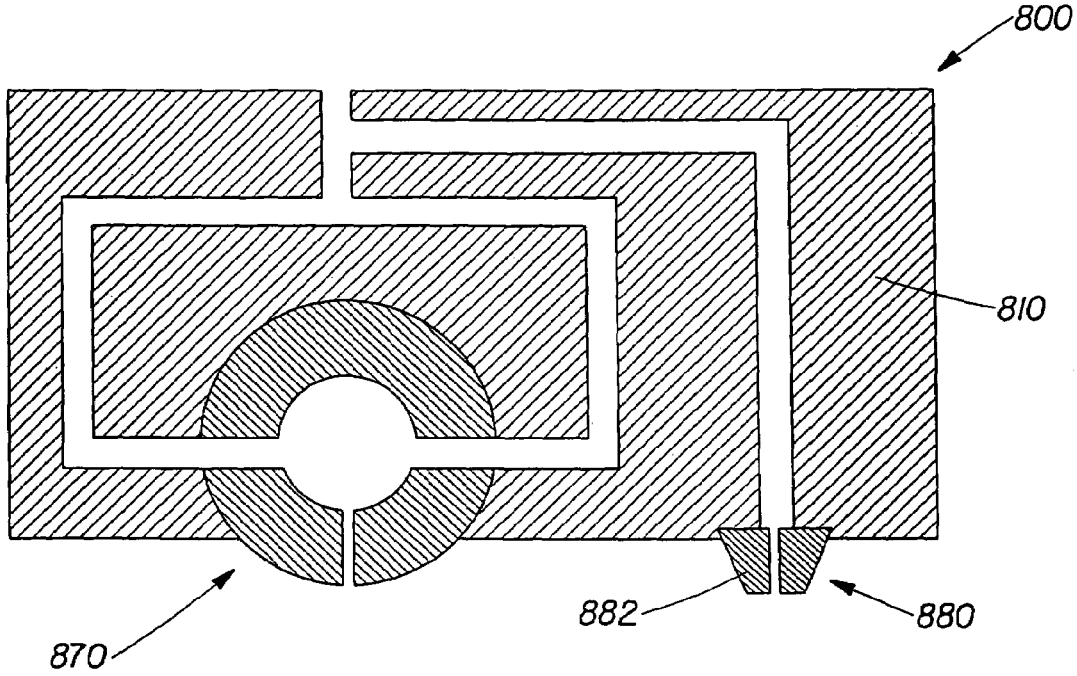
FIG. 16*a* is a cross-sectional view of yet another exemplary, non-limiting embodiment of an applicator, wherein a first and second applicator are incorporated into the same housing to provide linear and non-linear product applications.
Figure 16B:
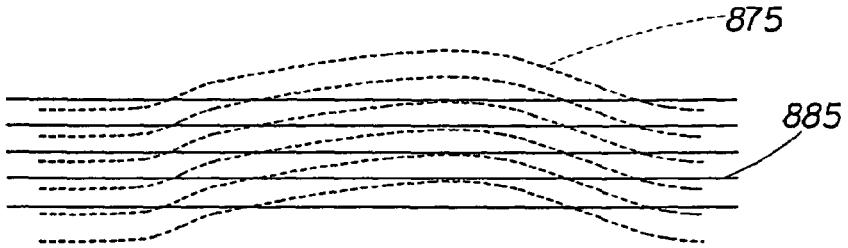
FIG. 16*b* illustrates exemplary strands of hot-melt extruded from the applicator of the embodiment of FIG. 16*a*.

Similar to the view of FIG. 15, FIG. 16*a* is a cross-sectional view of yet another exemplary, non-limiting embodiment of an applicator 800 in accordance with the present invention. In this embodiment, housing 810 includes a first applicator 870 and second applicator 880. The first applicator 870 is substantially similar to the applicator of FIG. 15. The second applicator 880 includes a stationary nozzle 882. When both the first applicator 870 and second applicator 880 are used to extrude hot-melt, a hot-melt product application containing a non-linear strand 875 and a linear strand 885, respectively, is achievable (see FIG. 16*b*).

Figure 17A:
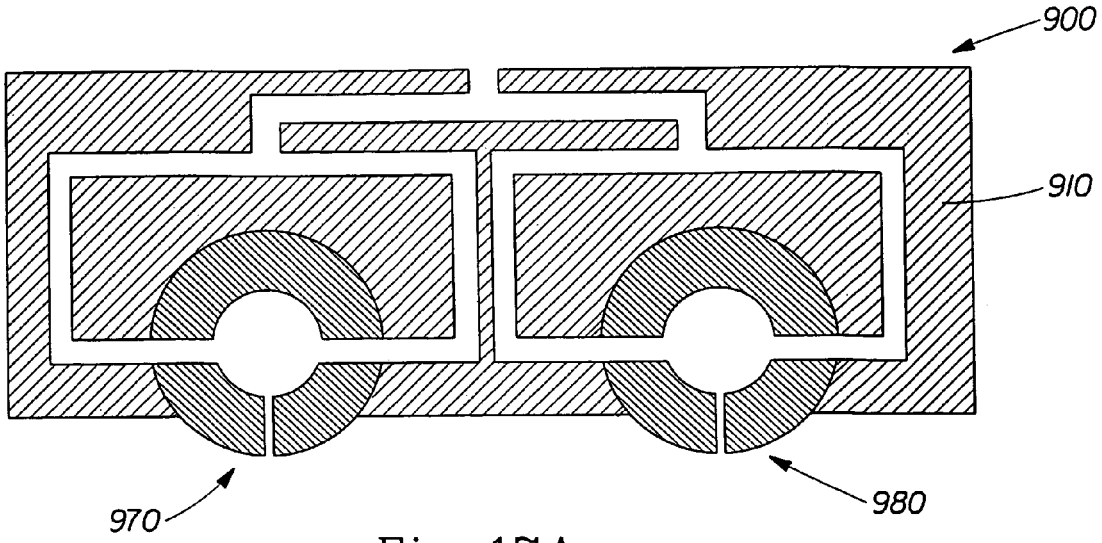
FIG. 17*a* is a cross-sectional view of still another exemplary, non-limiting embodiment of an applicator, wherein a first and second applicator are incorporated into the same housing to provide two types of and non-linear product applications.
Figure 17B:
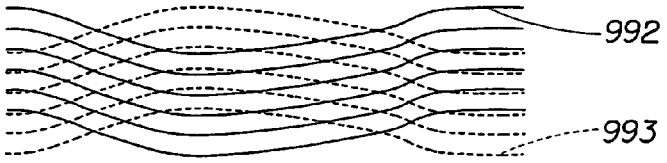
FIG. 17*b* illustrates exemplary strands of hot-melt exturded the applicator of the embodiment of FIG. 17*a*.

Similar to the view of FIG. 16*a*, FIG. 17*a* is a cross-sectional view of yet another exemplary, non-limiting embodiment of an applicator 900 in accordance with the present invention. In this embodiment, housing 910 includes a first applicator 970 and second applicator 980. Both first applicator 970 and second applicator 980 are substantially similar to the applicator of FIG. 15. When both the first and second applicator are used to extrude hot-melt, a hot-melt product application containing a first non-linear strand 992 and a second non-linear strand 993, respectively, is achievable (see FIG. 17*b*).

For example, while the first embodiment shows the use of nozzle reservoir 145 to serve as a manifold to feed hot-melt 192 to nozzle outlets 147, one skilled in the art would appreciate that said nozzle reservoir may be eliminated such that nozzle inlet 142 and nozzle outlet 147 are in direct fluid communication.

All documents cited are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An applicator for application of a substance onto a material comprising:

a housing, said housing comprising:

at least one housing inlet for the introduction of the substance into said housing, at least one housing channel in fluid communication with said housing inlet, and at least one housing outlet;

a valve, said valve comprising:

at least one valve channel being in fluid communication with said housing channel when said valve is in an open position, said valve channel not being in fluid communication with said housing channel when said valve is in a closed position, wherein said valve is translated in a linear motion to provide shuttering functionality, said valve channel in fluid communication with said housing outlet; and a nozzle, said nozzle comprising:

at least one nozzle inlet in fluid communication with said housing outlet, and at least one nozzle outlet in fluid communication with said nozzle inlet for the extrusion of the substance onto the material, wherein said housing is comprised of at least two housing channels, said housing channels being symmetrically opposed such that a substance supply force exerted on said valve is reduced.

2. The applicator of claim 1, wherein the material upon which the substance is applied is in the form of a continuous web.

3. The applicator of claim 1, wherein the material upon which the substance is applied is in the form of a drum.

4. The applicator of claim 1, wherein the material upon which the substance is applied is in the form of a belt.

5. The applicator of claim 1, wherein said nozzle further comprises at least one nozzle reservoir to provide manifold functionality of the substance, said nozzle reservoir being in fluid communication with said nozzle inlet and said nozzle outlet, said nozzle reservoir located between said nozzle inlet and said nozzle outlet.

6. The applicator of claim 1, wherein said valve is non-circular in shape.

7. The applicator of claim 1, wherein said valve is substantially rectangular in shape.

8. An applicator for application of a substance onto a material comprising:

a housing, comprising:

at least one housing inlet for the introduction of the substance into said housing, and at least one housing channel in fluid communication with said housing inlet; and a valve, comprising:

at least one valve inlet in fluid communication with said housing channel, said valve inlet being in fluid communication with said housing channel when said valve is in an open position, said valve inlet not being in fluid communication with said housing channel when said valve is in a closed position, at least one valve reservoir in fluid communication with said valve inlet to provide manifold functionality of the substance, and at least one valve outlet in fluid communication with said valve reservoir for the extrusion of the substance onto the material, wherein said housing is comprised of at least two housing channels, said housing channels being symmetrically opposed such that a substance supply force exerted on said valve is reduced.

9. The applicator of claim 8, wherein said valve is non-circular in shape.

10. The applicator of claim 8, wherein said valve is substantially rectangular in shape.

11. The applicator of claim 8, wherein the material upon which the substance is applied is in the form of a continuous web.

12. The applicator of claim 8, wherein the material upon which the substance is applied is in the form of a drum.

13. The applicator of claim 8, wherein the material upon which the substance is applied is in the form of a belt.

14. An applicator for application of a substance onto a material comprising:

a housing, comprising:

at least one housing inlet for the introduction of the substance into said housing, and at least one housing channel in fluid communication with said housing inlet; and a valve, comprising:

at least one valve inlet in fluid communication with said housing channel, said valve inlet being in fluid communication with said housing channel when said valve is in an open position, said valve inlet not being in fluid communication with said housing channel when said valve is in a closed position, at least one valve reservoir in fluid communication with said valve inlet to provide manifold functionality of the substance, and at least one valve outlet in fluid communication with said valve reservoir for the extrusion of the substance onto the material, a journal, said journal being connected to said valve, said journal and said valve translate together in a linear motion to provide shuttering functionality and profiled product application functionality.

15. The applicator of claim 14 wherein said applicator extrudes a continuous strand of hot-melt.

16. The applicator of claim 15, wherein said strand of hot-melt is non-linear.

17. The applicator of claim 15 wherein the material upon which the hot-melt is applied is in the form of a continuous web.

18. The applicator of claim 14 wherein the material upon which the substance is applied is in the form of a drum.

19. The applicator of claim 14 wherein the material upon which the substance is applied is in the form of a belt.

20. An applicator for application of a substance onto a material comprising:

a housing, comprising:

at least one housing inlet for the introduction of the substance into said housing, and at least one housing channel in fluid communication with said housing inlet; and a valve, comprising:

at least one valve inlet in fluid communication with said housing channel, said valve inlet being in fluid communication with said housing channel when said valve is in an open position, said valve inlet not being in fluid communication with said housing channel when said valve is in a closed position, at least one valve reservoir in fluid communication with said valve inlet to provide manifold functionality of the substance, and at least one valve outlet in fluid communication with said valve reservoir for the extrusion of the substance onto the material, a journal, said journal being connected to said valve, said journal and said valve translate together in a linear motion to provide profiled product application functionality and rotate together to provide shuttering functionality.

21. The applicator of claim 20, wherein said valve is non-circular in shape.

22. The applicator of claim 20, wherein said valve is substantially rectangular in shape.

23. The applicator of claim 20, wherein the material upon which the substance is applied is in the form of a continuous web.

24. The applicator of claim 20, wherein the material upon which the substance is applied is in the form of a drum.

25. The applicator of claim 20, wherein the material upon which the substance is applied is in the form of a belt.

* * * * *

UNITED STATES PATENT AND TRADEMARK OFFICE

CERTIFICATE OF CORRECTION

PATENT NO. : 7,169,228 B2
APPLICATION NO. : 10/834539
DATED : January 30, 2007
INVENTOR(S) : Uwe Schneider It is certified that error appears in the above-identified patent and that said Letters Patent is hereby corrected as shown below:

Column 3

Line 54, delete “and”.

Lines 56 and 57, delete “exturded” and insert -- extruded from --.

Column 4

Line 66, delete “2-3” and insert -- 3-3 --.

Column 11

Line 5, delete “15”, and insert -- 14 --.

Line 7, delete “15”, and insert -- 14 --.

Signed and Sealed this

Thirteenth Day of May, 2008

JON W. DUDAS
*Director of the United States Patent and Trademark Office*